US005716136A

United States Patent [19]

Kolbe et al.

[11] Patent Number: 5,716,136

[45] Date of Patent: Feb. 10, 1998

[54] BAG WITH CARRYING HANDLES

[75] Inventors: Wilfried Kolbe, Gülzow; Klaus Schirrich, Bielefeld; Diethard Obermeier, Bad Salzuflen, all of Germany

[73] Assignee: Fischer & Krecke GmbH & Co., Bielefeld, Germany

[21] Appl. No.: 629,235

[22] Filed: Apr. 8, 1996

[30] Foreign Application Priority Data

Jan. 4, 1996 [DE] Germany ..... 296 00 081.7

[51] Int. Cl.[6] ..... B65D 33/06

[52] U.S. Cl. ..... 383/14; 383/32

[58] Field of Search ..... 383/14, 32, 35, 383/37; 206/554

[56] References Cited

U.S. PATENT DOCUMENTS

| | | | |
|---|---|---|---|
| Re. 21,228 | 10/1939 | Steen | 383/32 X |
| 1,721,043 | 7/1929 | Duvall | 383/32 X |
| 2,346,710 | 4/1944 | Steen | 383/32 X |
| 2,603,408 | 7/1952 | Crary | 383/32 X |
| 2,625,318 | 1/1953 | Ross . | |
| 2,955,740 | 10/1960 | Finke . | |
| 3,023,946 | 3/1962 | Steen | 383/32 X |
| 3,142,435 | 7/1964 | Strange et al. | 383/14 X |

FOREIGN PATENT DOCUMENTS

| | | | |
|---|---|---|---|
| 5032258 | 2/1993 | Japan | 383/14 |

*Primary Examiner*—Jes F. Pascua

*Attorney, Agent, or Firm*—Richard M. Goldberg

[57] ABSTRACT

A bag includes two parallel walls, each with two side edges each; a bottom connected with lower ends of the two walls and which can be folded in a plane of the walls; and two carrying handles, which in each case have two parallel legs and one cross member connecting the two parallel legs and are fastened with fastening sections, formed at their legs, in each case to one of the walls of the bag and are folded back on themselves at fold lines, so that they do not protrude beyond the walls and are detachably fixed to the bag, the cross members of the two carrying handles being offset from each other in the folded-back position by an amount, which corresponds at least to the width of the cross members and the fold lines of the two carrying handles being mutually offset by about half this amount, and the carrying handles being mutually offset in a direction perpendicular to the side edges to such an extent, that the parallel legs of the two handles do not overlap one another.

10 Claims, 1 Drawing Sheet

BAG WITH CARRYING HANDLES

BACKGROUND OF THE INVENTION

The invention relates to a bag with carrying handles.

Such bags are made available to customers as carrying bags, for example, in supermarkets. For reasons of protecting the environment, the bags are generally produced from strong paper, which can be disposed of or recycled without problems. The carrying handles are usually also formed from paper strips, which have been folded into several layers and are shaped into U-shaped handles by being folded over twice at right angles. These handles in each case have two parallel legs and a cross member connecting them. Each bag is provided with two such handles, which are glued with fastening sections at the ends of the parallel legs to the two parallel walls of the bag in such a manner that, in the use position, they protrude beyond the opening of the bag.

A paper bag of the above-named type, for which the carrying handles are glued to the outside of the walls of the bag, is described in the DE 94 14 380 U and in the corresponding U.S. patent application Ser. No. 08/328,288. So that the protruding parts of the carrying handle do not interfere with the manufacture, stacking and packaging of the bags, they are folded back on themselves through 180° and fastened in the folded over position provisionally to the bag with the help of a separable adhesive.

Admittedly, a compact stack or package of bags, lying flat on top of one another, becomes possible in this manner. However, there is a relatively strong build-up of material during stacking in the region of the open ends of the bags, because the carrying handles, which consist in turn of several layers of material, lie on top of one another there. This makes it difficult to stack and package the bags into a compact package.

SUMMARY OF THE INVENTION

It is therefore an object of the invention to provide a bag, which can be stacked better and enables a compact stack or package to be formed.

The two carrying handles are mutually offset in the folded-over state by an amount, which corresponds at least to the width of these cross members, and the fold lines, at which the parallel legs of the carrying handle are folded over, are offset from one another by about half of this amount.

By these measures, it is achieved that the cross members of the carrying handles do not lie on top of one another in the folded-over state, so that the build-up of material during stacking is reduced. In particular, the transitional regions between the cross members and the parallel legs, in which double the thickness of material exists because of the right angle folding, are also mutually offset. On the other hand, by offsetting the fold lines, it is achieved that the cross members of the carrying handles are at the same height in the use position and accordingly, when the bag is being carried, are put under load uniformly by the weight of the contents of the bag.

Further, the parallel legs of the two carrying handles in each case are mutually offset at least by their width. By these means also, the build-up of material is reduced particularly in the transitional regions between the parallel legs and the cross members of the carrying handles. The two parallel walls of the bag are connected to one another by side folds. Because of these side folds, the parallel walls of the bag can shift relative to one another to such an extent in the use position, that the two carrying handles are flush with one another, so that the user can conveniently put his hand through the opening formed by the cross members and the parallel legs of the two carrying handles. Since the carrying handles are fixed to the outside of the walls of the bag, the side folds can extend inwards to such an extent when the bag is laid flat, that they in each case overlap one of the legs of the carrying handles, without interfering with the unfolding of the carrying handle into the use position.

In a particularly preferred embodiment, the two measures described above, are combined with one another.

BRIEF DESCRIPTION OF THE DRAWINGS

In the following, a preferred embodiment is described in greater detail by means of the drawing, in which.

DESCRIPTION OF THE PREFERRED EMBODIMENTS

Figure 1:
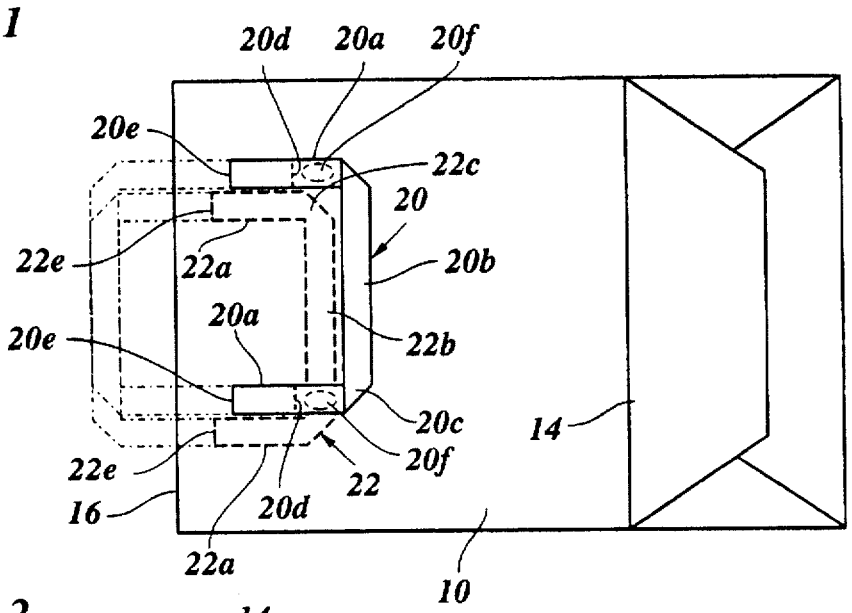
FIG. 1 shows an outline of a bag in the state, in which it is laid flat.
Figure 2:
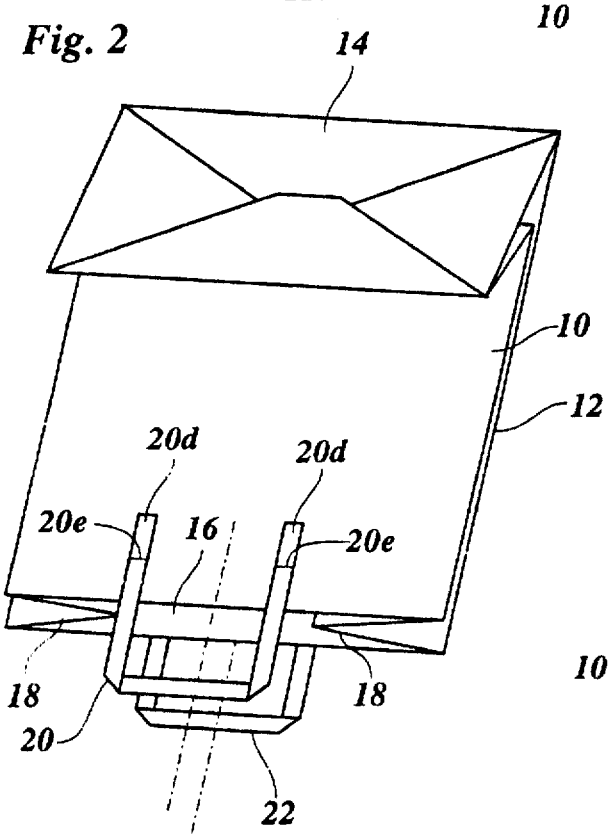
FIG. 2 shows a perspective view of the bag in the state in which it is laid flat and FIG. 3 shows a partial perspective view of the bag in the use position.

The bag, shown in FIGS. 1 and 2, is made completely from paper and has two parallel walls 10, 12 and a rectangular bottom 14 which, in the state shown in FIGS. 1 and 2, is folded flat in the plane of the walls 10, 12, so that several bags can be stacked on top of one another into a compact package. At the end of the bag, opposite to the bottom 14, an opening 16 is defined by the walls 10, 12. The side edges of the walls 10, 12 are connected to one another by side folds 18, which are drawn inward (FIG. 2).

A carrying handle 20 or 22 is affixed to the walls 10, 12 in each case on the outside. Each carrying handle is formed by a paper strip, which has been folded into several layers and folded over twice at right angles, so that a U-shaped structure results. Accordingly, the carrying handle 20 has two parallel legs **20*a*, which are connected to one another by a cross member 20*b*. Because of the right angle folding-over of the strip forming the carrying handle, triangular regions 20*c* are formed, in which the cross member 20*b* overlaps with the legs 20*a*, so that a double thickness of material exists there. The free ends of the legs 20*a* form the fastening sections 20*d*, which are glued to the wall 10** of the bag.

In the state shown in FIG. 1, the carrying handle 20 is folded back on itself at fold lines **20*e*, so that it does not protrude beyond the opening 16. The folded-back part of the carrying handle is fixed in the folded-back position with the help of a separable adhesive 20*f* (in dashed lines). When the carrying handle is to be transferred into the use position of FIG. 2, it is torn off at the separable adhesive sites and folded over through 180° at the fold lines 20*e*, so that it assumes the position drawn by the lines of dots and dashes in FIG. 1**.

The carrying handle 22 is built up and fastened in the same way as the carrying handle 20 and accordingly has parallel legs **22*a* with fold lines 22*e* and fastening sections 22*d*, as well as a cross member 22*b*, which is connected with the legs 22*a* by transitional triangular regions 22*c***.

As can be seen in FIG. 1, the cross members **20*b*, 22*b* are mutually offset in the longitudinal direction of the bag in the folded-back state to such an extent, that they do not overlap mutually. The fold lines 20*e* and 22*e* in the legs of the carrying handles are also mutually offset; however, the offsetting here is only half as great as in the case of the cross members 20***b*, 22*b*. Therefore, when the two carrying handles are folded over into the use position, which is drawn by lines of dots and dashes in FIG. 1, the cross members 20*b* and 22*b* are at the same height. Therefore, when the cross members of the carrying handles are taken hold of by hand, in order to carry the bag with the contents, the weight of the contents of the bag acts uniformly on both carrying handles, so that the latter are prevented from being torn off.

As can also be recognized in FIG. 1, the two carrying handles 20, 22 are also mutually offset in the width direction of the bag to such an extent, that their legs 20*a* and 22*a* do not overlap. Overall, it is achieved by these measures that, in the state of FIG. 1 in which the bags can be stacked, the build up of material in the region of the carrying handles 20, 22 is only approximately as great as that in the region of the bottom 14. Consequently, when bags are stacked on top of one another in large numbers, the stack heights at the two ends are approximately the same.

As shown in FIG. 2, the side folds 18 in the case of the embodiment described extend inwards to such an extent that, because of the offsetting of the carrying handles 20, 22, they overlap in each case one leg of one of the carrying handles. However, since the carrying handles are affixed to the outside of the walls 10, 12 in the examples shown, the unfolding of the carrying handles into the use position is not hindered by these means.

Figure 3:
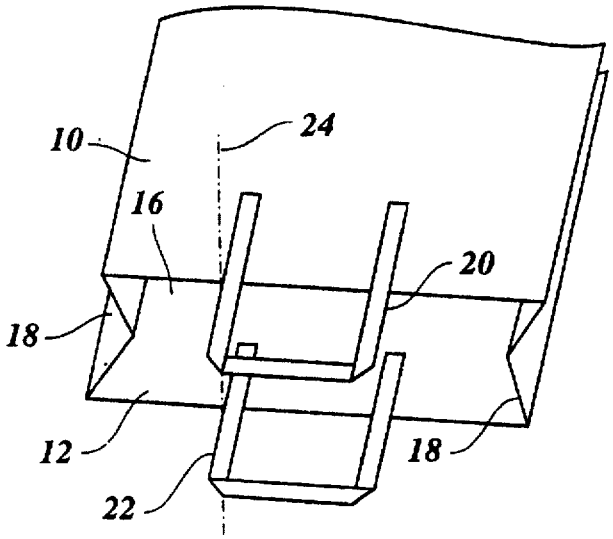

In the state shown in FIGS. 1 and 2, the two carrying handles 20, 22 are mutually offset in the width direction of the bag. However, when the side walls 10, 12 are pulled apart in order to expand the opening 16, as shown in FIG. 3, the walls 10, 12 of the bag, because of the yielding of the side fold 18, can shift to such an extent relative to one another, that the carrying handles 20, 22 are aligned with one another in the direction 24 perpendicular to the plane of the walls 10, 12. In this manner, the two carrying handles form two grip openings, which are flush with one another and are so wide, that the user can conveniently take hold of the carrying handles.

We claim:

1. A bag comprising:

a) two parallel walls, b) a bottom connected with lower ends of the two walls and folded into a plane of the walls in a folded condition of the bag, and c) two carrying handles, each carrying handle including:

i) two parallel legs, each leg including:

A) a fastening section secured to one of the walls of the bag, and

B) a fold line at which the leg is folded back on itself to a folded-back position so that the leg does not protrude beyond outer edges of said walls in the folded condition of the bag, and ii) one cross member connecting together the two parallel legs, each cross member having a width, the cross members of the two carrying handles being offset from each other in the folded-back position by an amount equal at least to the width of the cross members, and the fold lines of the two carrying handles being mutually offset from each other by about half this amount, such that the cross members of the two handles will be superposed with respect to each other after the handles have been unfolded in an open, use position of the bag.

2. The bag of claim 1, in which the carrying handles are mounted on outside surfaces of the walls of the bag and, in the folded-back position, are detachably fixed to the bag.

3. The bag of claim 1, in which each carrying handle is formed from a straight strip of material, which is folded over at right angles in transitional regions of each handle between the cross member and the legs.

4. A bag comprising:

a) two parallel walls, each with two side edges extending in a lengthwise direction, b) a bottom connected with lower ends of the two walls and folded in a plane of the walls in a folded condition of the bag, c) two carrying handles, each carrying handle including:

i) two parallel legs, each leg including:

A) a fastening section secured to an outside surface of one of the walls of the bag, and B) a fold line at which the leg is folded back on itself to a folded-back position so that the leg does not protrude beyond outer edges of said walls in the folded condition of the bag, and ii) one cross member connecting together the two parallel legs, d) side folds which connect the side edges of the two walls with one another, and e) the carrying handles being offset mutually in a transverse direction perpendicular to the lengthwise direction of said walls to such an extent, that the parallel legs of one handle are offset in the same transverse direction from the parallel legs of the other handle and do not overlap one another, and the cross member of one carrying handle crosses over one leg of the other carrying handle in the folded condition of the bag, and such that the parallel legs of one carrying handle overlap with the parallel legs of the other carrying handle by laterally shifting the two walls of the bag relative to each other in an open, use condition of the bag.

5. The bag of claim 4, in which, in the state in which the bottom is folded in the plane of the walls, the side folds extend into an interior of the bag so that the side folds overlap with at least one of the legs of one of the carrying handles.

6. The bag of claim 4, in which the carrying handles in the folded-back position are detachably fixed to the bag.

7. The bag of claim 4, in which each carrying handle is formed from a straight strip of material, which is folded over at right angles in a transitional region of each handle between the cross member and the legs.

8. A bag comprising:

a) two parallel walls, each with two side edges extending in a lengthwise direction, b) a bottom connected with lower ends of the two walls and folded in a plane of the walls in a folded condition of the bag, and c) two carrying handles, each carrying handle including:

i) two parallel legs,

A) a fastening section secured to an outside surface of one of the walls of the bag, and B) a fold line at which the leg is folded back on itself to a folded-back position so that the leg does not protrude beyond outer edges of said walls in the folded condition of the bag, and ii) one cross member connecting together the two parallel legs, each cross member having a width, the cross members of the two carrying handles being offset from each other in the folded-back position by an amount equal at least to the width of the cross members and the fold lines of the two carrying handles being mutually offset by about half this amount such that the cross members of the two handles will be superposed with respect to each other after the handles have been unfolded in an open, use position of the bag, and the carrying handles being mutually offset in a transverse direction perpendicular to the lengthwise direction of said side edges to such an extent, that the parallel legs of one handle are offset in the same transverse direction from the parallel legs of the other handle and do not overlap one another, and the cross member of one carrying handle crosses over one leg of the other carrying handle in the folded condition of the bag, and such that the parallel legs of one carrying handle overlap with the parallel legs of the other carrying handle by laterally shifting the two walls of the bag relative to each other in the open, use condition of the bag.

9. The bag of claim 8, in which the carrying handles are mounted to outside surfaces of the walls of the bag and, in the folded-back position, are detachably fixed to the bag.

10. The bag of claim 8, in which each carrying handle is formed from a straight strip of material, which is folded over at right angles in a transitional region of each handle between the cross member and the legs.

* * * * *